US006402146B1

(12) United States Patent
Goller

(10) Patent No.: US 6,402,146 B1
(45) Date of Patent: Jun. 11, 2002

(54) EXPEDITED PLAY, CHESS-LIKE GAME

(76) Inventor: Marcus Goller, 8088 Branch Dr., Brighton, MI (US) 48116

( * ) Notice: Subject to any disclaimer, the term of this patent is extended or adjusted under 35 U.S.C. 154(b) by 0 days.

(21) Appl. No.: 09/567,815

(22) Filed: May 9, 2000

(51) Int. Cl.[7] ..... A63F 3/02
(52) U.S. Cl. ..... 273/260
(58) Field of Search ..... 273/260, 261

(56) References Cited

U.S. PATENT DOCUMENTS

| | | | | |
|---|---|---|---|---|
| 1,405,988 | A | 2/1922 | Erwin | |
| 3,656,756 | A | 4/1972 | Gribbon, Jr. | |
| 3,684,285 | A | 8/1972 | Kane | |
| 3,767,201 | A | 10/1973 | Harper et al. | |
| 3,794,326 | A | 2/1974 | Bialek | |
| 3,885,791 | A | 5/1975 | Chouinard | |
| 3,887,190 | A | 6/1975 | Ameri | |
| 3,897,953 | A * | 8/1975 | Hovnanian | 273/260 |
| 3,938,808 | A | 2/1976 | Bockmon, Jr. | |
| 4,150,828 | A | 4/1979 | Marchese | |
| 4,411,433 | A | 10/1983 | Flynn | |
| 4,504,060 | A | 3/1985 | Riihiluoma et al. | |
| 5,257,787 | A | 11/1993 | Miccio | |
| 5,449,178 | A | 9/1995 | Castronova | |
| 5,464,224 | A | 11/1995 | Rosenbaum | |
| 5,484,157 | A * | 1/1996 | King | 273/260 |
| 5,642,885 | A | 7/1997 | Gustin | |
| 5,647,593 | A | 7/1997 | Kamat et al. | |
| 5,667,223 | A | 9/1997 | Yedid | |
| 5,695,191 | A | 12/1997 | Frost | |
| 5,957,455 | A * | 9/1999 | Aldridge | 273/260 |

OTHER PUBLICATIONS

"Petty Chess", B. Walker Watson, www.chessvariants.com, Sep. 1996.*
"Quick Chess", Joe Miccio, www.chessvariants.com, Jan. 1996.*
"Patricia", Rob Nierse, www.chessvariants.com, Jan. 1997.*
"Re", Dr. Reiner Knizia, www.chessvariants.com, Nov. 1996.*
"Pre–Chess", "Screen Chess", New Rules For Classic Games, R. Wayne Schmittberger, John Wiley & Sons, Inc., 1992, pp. 186–187, 190.*

* cited by examiner

*Primary Examiner*—Benjamin H. Layno
(74) *Attorney, Agent, or Firm*—Gifford, Krass, Groh, Sprinkle, Anderson & Citkowski, PC

(57) ABSTRACT

A reduced-complexity, chess-like game uses ten pieces on a smaller square board without pawns for expedited play. Each player has a King (K), Queen (Q), Bishop (B), Knight (Kn), and Rook (R). Movement of the pieces is essentially the same as in traditional chess with a few minor exceptions. The object of the game is to capture the opponent's King, at which time the King is ransomed, and the game is over. Four different set-up procedures are disclosed, ranging from two static setups (Joust and Royal Court) to an intermediate version (Field) to blind setup (Assault). As an option, each game includes five tokens or coins called crowns. These may be used when players agree to do so. At the start of a game, each player places a crown in the center square. At the end of the game, the losing player's King is ransomed with the wagered crown coin. The object is to win all the crown coins. The player who challenges another always gets the first move except in Assault. The challenged player gets to choose the game. Players use alternate moves thereafter.

5 Claims, 1 Drawing Sheet

EXPEDITED PLAY, CHESS-LIKE GAME

FIELD OF THE INVENTION

The present invention relates generally to board games and, in particular, to a chess-like game played on a smaller board without pawns.

BACKGROUND OF THE INVENTION

Modern, Western chess appeared in Southern Europe sometime around the end of the $15^{th}$ Century, and soon became popular throughout Europe. The game evolved somewhat as the powers of certain pieces were increased, and new rules were added such as castling, two-square pawn advance, and en passant. Other than these changes, the game has remained essentially the same for hundreds of years.

Traditional chess is elegant and difficult to improve. Nevertheless, many ideas have been proposed and implemented to make the game more difficult and easier to play. To make the game more challenging, larger boards and stacked, three-dimensional arrangements have been proposed.

To make the game easier or faster, smaller boards with fewer pieces and modified rules have been suggested. In U.S. Pat. No. 5,257,787, a chess-like game is- disclosed to simplify the teaching and playing of basic chess. The concept uses a game board with five vertical rows and six horizontal rows, and a reduced number of pieces. Each opponent's set includes one each of a king, queen, bishop, knight and rook, plus five pawns. This lesser number of pieces are set up on the smaller game board such that they still incorporate many of the basic interrelationships and strategic aspects of conventional chess while permitting a more rapid and simpler game.

SUMMARY OF THE INVENTION

Figure 1:
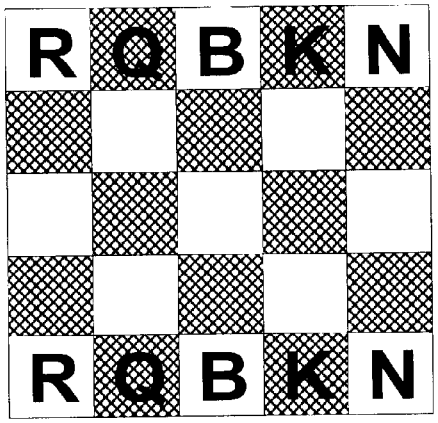
FIG. 1. is a top-down drawing of a fixed setup embodiment of the invention called Joust.

This invention resides in a reduced-size chess-like game which differs from the traditional game through less complexity by providing fewer pieces and a smaller board. In contrast to existing simplified versions of the game, pawns are not used. With no pawns to hide behind, players are brought into end game combat from the outset. The game can be very quick, much faster than a traditional game.

The game board is a five-by-five square checkerboard with thirteen light squares and twelve dark squares. There are two sets of player pieces, as in traditional chess. Each player has a King (K), Queen (Q), Bishop (B), Knight (Kn), and Rook (R). Movement of the pieces is essentially the same as in traditional chess with a few minor exceptions. One difference is that the Queen moves like the King, that is, one space at a time in any direction. There is no need to warn the opponent when their King is in check, and there is no checkmate. If the King can move, he must, even if it means capture. The object of the game is to capture the opponent's King, at which time the King is ransomed, and the game is over. Players may agree to a draw.

There are four different set-up procedures ranging from static setups (Joust and Royal Court) to an intermediate version (Field) to blind setup (Assault). With the Joust setup, the pieces are ordered as Rook, Queen, Bishop, King, and Knight on the five squares closest to each player such that opposing pieces of the same type face each another. With Royal Court, the setup is Queen, King, Bishop, Knight, Rook, the pieces on each side being mirror images of one another, again, on the five squares closest to each player.

With Field, both players set up one piece at a time on the baseline separately, with precautions preferably being taken so that the King does not get taken on the first move. With Assault, the players secretly write down their setup on a piece of paper using an unambiguous description. The first move in this case is preferably determined by a coin toss. If the King can be taken on the first move, the opponent is first given a defensive move, afterwhich play officially begins.

As an option, each game includes five tokens or coins called crowns. These may be used when players agree to do so. At the start of a game, each player places a crown in the center square. At the end of the game, the losing player's King is ransomed with the wagered crown coin. The object is to win all the crown coins. The player who challenges another always gets the first move except in Assault. The challenged player gets to choose the game. Players use alternate first moves thereafter.

DETAILED DESCRIPTION OF THE INVENTION

The game board is a five-by-five square checkerboard with thirteen light squares and twelve dark squares. There are two sets of player pieces, as in traditional chess. Each player has a King (K), Queen (Q), Bishop (B), Knight (Kn), and Rook (R). One player has light colored pieces, while the other player takes the dark pieces. The object of the game is to capture the opponent's King, at which time the King is ransomed, and the game is over.

Movement of the pieces is the same as traditional chess, except for the following exceptions:

- The Queen moves like the King, that is, one space at a time in any direction;
- Players need not inform the opponent when their King is in check;
- There is no checkmate; instead, the King is captured;
- The King may not resign; if he can move, he must; and
- Players may not castle as in traditional chess.

Game Setup

There are four basic game starts ranging from two static setups (Joust and Royal Court) to an intermediate version (Field) to blind setup (Assault). These are described as follows:

Joust—A fixed setup embodiment to begin a friendly game for entertainment. From left to right on the baseline squares closest to one player, the pieces are set up as Rook, Queen, Bishop, King, and Knight. The opponent sets up in mirror-image fashion so the same opposing pieces face one another, as shown in FIG. 1. The player with the light-colored pieces moves first.

Figure 2:
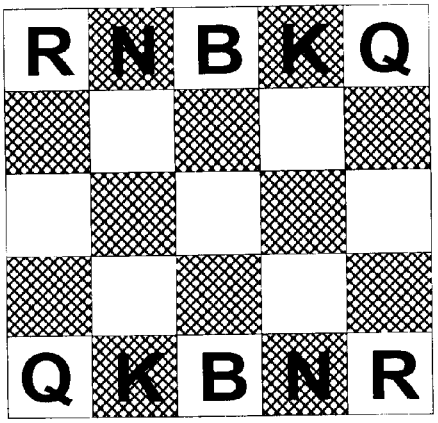
FIG. 2 is a top-down drawing of an alternative fixed setup embodiment of the invention called Royal Court.

Royal Court—A fixed setup embodiment wherein, from left to right on the baseline squares closest to each player, the pieces are set up as Queen, King, Bishop, Knight, Rook. The opponent sets up in the identical way from left to right so the Queen faces opponent's Rook, as shown in FIG. 2. The player with the light-colored pieces moves first.

Field—This is a more challenging embodiment of ever-changing strategy. Each player places one piece on his/her baseline of the board in turn, with the only proviso being that care should be taken to ensure that the King is not immediately captured (though this is not against the rules). The player with the light-colored pieces places the first piece on a square, followed by the player with the darker pieces, and so on until the fifth dark-colored piece is placed. This allows the strategy to begin as the first piece is set on a square, and the strategy change as each subsequent piece is place. When all pieces are set, play begins with the light-colored piece moving first.

Assault—An embodiment including dimensions of surprise, luck, and skill, the outcome is so unpredictable that a novice can beat a master. Each player secretly writes down their setup on a piece of paper using an unambiguous description. For example: "from my left to right: B, R, K, Kn, Q." When both players are ready they place their setups in plain view and setup accordingly. The first move in this case is preferably determined by a coin toss. If the King can be taken on the first move, the opponent is first given a defensive move, afterwhich play officially begins.

Play Options

Crown Coin—As an option, each game includes five tokens or coins called crowns. These may be used when players agree to do so. At the start of a game, each player places a crown in the center square. At the end of the game, the losing player's King is ransomed with the wagered crown coin. The object is to win all the crown coins.

The player who challenges another always gets the first move except in Assault. The challenged player gets to choose the game. Players use alternate first moves thereafter.

I claim:

1. An expedited play chess-like game, consisting of:

a board having five vertical and five horizontal squares of alternating color or design; and a King (K), Queen (Q), Bishop (B), Knight (Kn), and Rook (R) for each of two players, with the playing pieces of one player being visually distinguishable from the pieces of the other.

2. A method of setting up an expedited-play, chess-like game, comprising the steps of:

providing the board and playing pieces of claim 1; and arranging the pieces for each player on the five squares closest to each player in the following order: R-B-Q-K-Kn, whereby the same opposing pieces on each side face one another.

3. A method of setting up an expedited-play, chess-like game, comprising the steps of:

providing the board and playing pieces of claim 1; and arranging the pieces for each player on the five squares closest to each player in the following order, from left to right with respect to each player: Q-K-B-N-R, whereby the same pieces on each side are mirror images of one another.

4. A method of setting up an expedited-play, chess-like game, comprising the steps of:

providing the board and playing pieces of claim 1; and each player alternatingly placing the pieces on five squares closest to each player, one piece at a time, until all of the pieces are on the board.

5. A method of setting up an expedited-play, chess-like game, comprising the steps of:

providing the board and playing pieces of claim 1; and placing the pieces on the five squares closet to each player, with the order of the pieces being determined secretely in advance by each players.

* * * * *